US010063017B2

(12) United States Patent
Kiryu et al.

(10) Patent No.: US 10,063,017 B2
(45) Date of Patent: Aug. 28, 2018

(54) CONNECTOR

(71) Applicants: FUJITSU COMPONENT LIMITED, Tokyo (JP); NTT FACILITIES, INC., Tokyo (JP)

(72) Inventors: Koichi Kiryu, Nagano (JP); Manabu Shimizu, Tokyo (JP); Masatoshi Noritake, Tokyo (JP); Keiichi Hirose, Tokyo (JP)

(73) Assignees: FUJITSU COMPONENT LIMITED, Tokyo (JP); NTT FACILITIES, INC., Tokyo (JP)

( * ) Notice: Subject to any disclaimer, the term of this patent is extended or adjusted under 35 U.S.C. 154(b) by 14 days.

(21) Appl. No.: 14/898,786

(22) PCT Filed: Jun. 23, 2014

(86) PCT No.: PCT/JP2014/066552
§ 371 (c)(1),
(2) Date: Dec. 16, 2015

(87) PCT Pub. No.: WO2014/208498
PCT Pub. Date: Dec. 31, 2014

(65) Prior Publication Data

US 2016/0372873 A1 Dec. 22, 2016

(30) Foreign Application Priority Data

Jun. 26, 2013 (JP) ..... 2013-134110

(51) Int. Cl.
*H01R 13/66* (2006.01)
*H01R 13/703* (2006.01)
(Continued)

(52) U.S. Cl.
CPC ..... *H01R 13/7038* (2013.01); *H01R 24/70* (2013.01); *H01R 2103/00* (2013.01)

(58) Field of Classification Search
CPC .. H01R 13/66; H01R 13/665; H01R 13/6675; H01R 13/6691; H01R 13/70;
(Continued)

(56) References Cited

U.S. PATENT DOCUMENTS 6,878,894 B2 * 4/2005 Schwarz ..... H01H 15/107 200/341
7,585,183 B2 * 9/2009 Shimazu ..... H01H 13/503 439/530
(Continued)

FOREIGN PATENT DOCUMENTS

CN 2080712 U 7/1991
CN 201766257 U 3/2011
(Continued)

OTHER PUBLICATIONS

English Translation of Hiroyuki JP 2011-192591.*
International Search Report dated Jul. 15, 2014.

*Primary Examiner* — Michael A Lyons
*Assistant Examiner* — Matthew T Dzierzynski
(74) *Attorney, Agent, or Firm* — IPUSA, PLLC

(57) ABSTRACT

A connector that is to be connected to another connector and includes a connection terminal, a fixed contact, a movable contact provided at an end of a movable plate, a card comprised of an insulator and configured to move the movable plate, and a button configured to move the card. The connector is configured such that while another connection terminal of the another connector is in contact with the connection terminal of the connector, the button is moved by the another connector, and the movable plate is moved by the card to cause the movable contact to contact the fixed contact.

7 Claims, 13 Drawing Sheets

(51) Int. Cl.
*H01R 24/70* (2011.01)
*H01R 103/00* (2006.01)

(58) Field of Classification Search
CPC .. H01R 13/701; H01R 13/703; H01R 13/713; H01R 13/71; H01R 13/7031
USPC ..... 439/188; 200/51.09, 341, 520, 529, 533
See application file for complete search history.

(56) References Cited

U.S. PATENT DOCUMENTS 7,942,684 B1 * 5/2011 Beak ..... H01R 13/639 200/51.12
7,982,144 B2 * 7/2011 Kiryu ..... H01R 13/7038 200/51 R
8,573,993 B2 * 11/2013 Beak ..... H01R 13/7033 200/51.09
8,664,553 B2 * 3/2014 Yuba ..... H01H 13/52 200/268
9,225,125 B2 * 12/2015 Iwamoto ..... H01R 13/70
9,281,635 B2 * 3/2016 Beak ..... H01R 13/7132
9,466,926 B2 * 10/2016 Yuba ..... H01H 15/02
2013/0037519 A1 2/2013 Yuba et al.
2013/0040502 A1 2/2013 Beak et al.
2013/0231007 A1 9/2013 Iwamoto et al.
2016/0071663 A1 * 3/2016 Iwamoto ..... H01H 13/14 200/51 R

FOREIGN PATENT DOCUMENTS

CN 102437474 5/2012
CN 102931005 2/2013
JP H05-082208 4/1993
JP H11-233203 8/1999
JP 2003-031301 1/2003
JP 2009-205814 9/2009
JP 2011-192591 9/2011
JP 2012-104448 5/2012
JP 2013-041694 2/2013

* cited by examiner

CONNECTOR

TECHNICAL FIELD

The present invention relates to a connector.

BACKGROUND ART

Generally, an electric apparatus is driven by electric power supplied from a power supply. An electric apparatus typically receives electric power via a connector from a power supply. Patent Documents 1 and 2 disclose a connector unit including a protruding male connector and a hollow female connector that are fitted together to be electrically connected.

In recent years, as a measure to cope with global warming, it is being considered to use, even for power transmission in local areas, a direct-current high-voltage power that suffers less power loss during voltage conversion and power transmission and does not necessitate increasing the diameter of a cable. Supplying electric power in this manner is particularly preferable for an information apparatus such as a server that consumes a large amount of electric power.

On the other hand, when electric power supplied to an electric apparatus has a high voltage, the electric power may affect the human body and operations of electronic components.

When such a high-voltage power is used for an information apparatus such as a server that is installed and maintained by a human, it is necessary to use, for electric connection, a connector that is different from a connector used for a normal alternating-current commercial power supply.

RELATED-ART DOCUMENTS

Patent Documents

[Patent Document 1] Japanese Laid-Open Patent Publication No. 05-82208

[Patent Document 2] Japanese Laid-Open Patent Publication No 2003-31301

[Patent document 3] Japanese Laid-Open Patent Publication No. 2012-104448

SUMMARY OF INVENTION

Technical Problem

When an electric power supplied from a power supply has a voltage greater than or equal to 100V or is a direct-current high-voltage power, a currently-available switch cannot be used without change for a switch-equipped connector. For example, when an electric power supplied from a power supply has a direct-current voltage of 400 V, it is dangerous to use a currently-available switch for an alternating-current voltage of 100V without change because sufficient safety and reliability cannot be ensured.

The present invention is made under the above background, and one object of the present invention is to provide a connector that can safely supply a high-voltage electric power.

Solution to Problem

According to an aspect of an embodiment, there is provided a connector to be connected to another connector. The connector includes a connection terminal, a fixed contact, a movable contact provided at an end of a movable plate, a card comprised of an insulator and configured to move the movable plate, and a button configured to move the card. The connector is configured such that while another connection terminal of the another connector is in contact with the connection terminal of the connector, the button is moved by the another connector, and the movable plate is moved by the card to cause the movable contact to contact the fixed contact.

Advantageous Effects of Invention

The present invention makes it possible to provide a connector that supports a power supply with a voltage higher than the voltage of an existing commercial power supply or a direct-current power supply, and that can safely supply electric power from such a power supply.

DESCRIPTION OF EMBODIMENTS

Embodiments of the present invention are described below. The same reference number is assigned to the same component, and repeated descriptions of the same component are omitted.

<Configuration of Connector>

Figure 8:
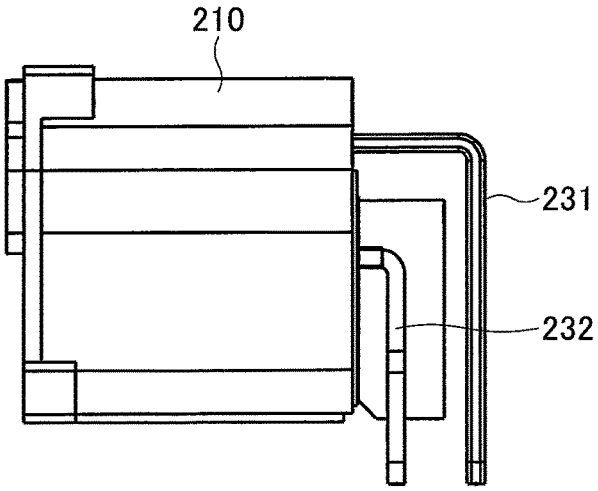
FIG. 8 is a front view of a plug connector according to an embodiment.
Figure 9:
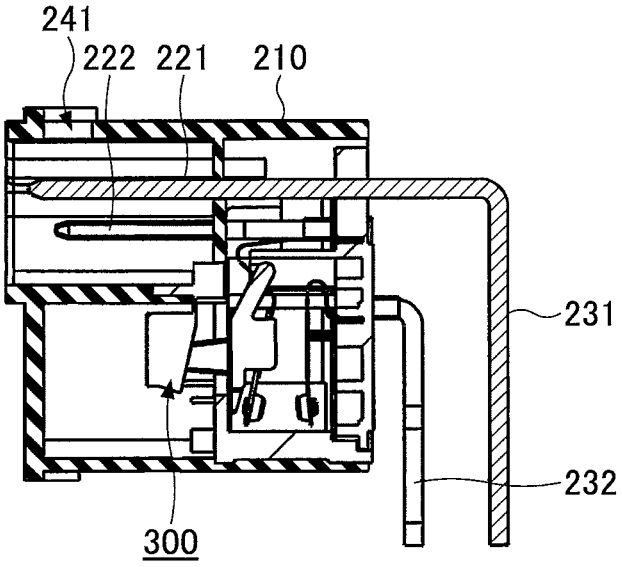
FIG. 9 is a cut-away view of a plug connector according to an embodiment.
Figure 10:
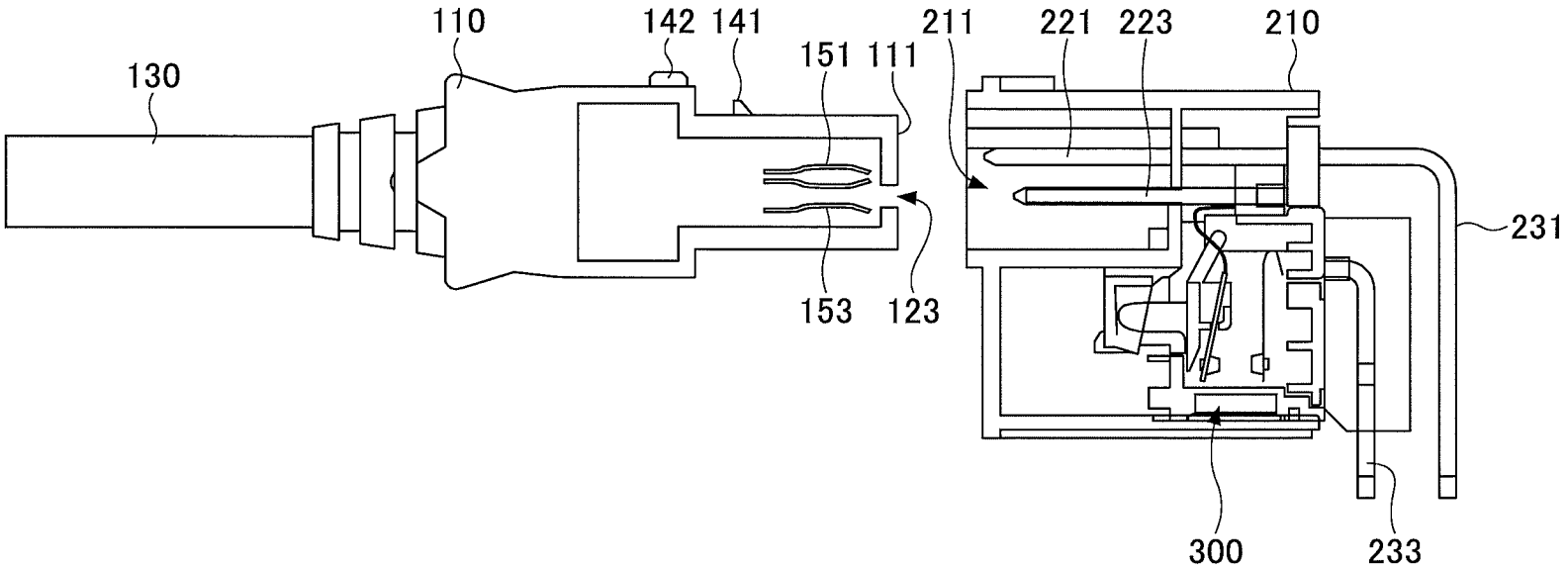
FIG. 10 is a cut-away view of a plug connector and a jack connector according to an embodiment.
Figure 11:
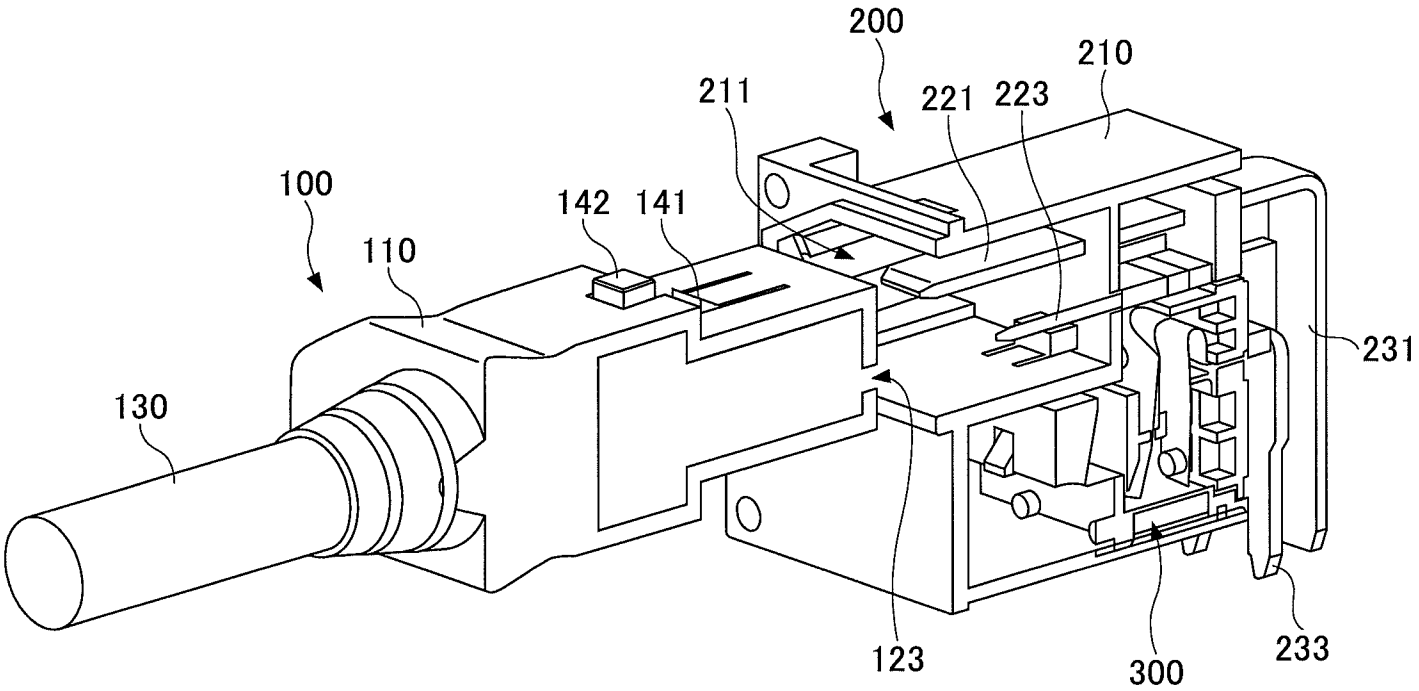
FIG. 11 is a cut-away perspective view of a plug connector and a jack connector according to an embodiment.

A configuration of a connector according to an embodiment is described below. A connector of the present embodiment is to be connected to another connector, which is a jack connector illustrated by FIGS. 1 through 4, and corresponds to a plug connector whose configuration is illustrated by FIGS. 5 through 9. In the present embodiment, the jack connector illustrated by FIGS. 1 through 4 and the connector corresponding to the plug connector illustrated by FIGS. 5 through 9 may be collectively referred to as a "connector". FIG. 10 is a cut-away view and FIG. 11 is a cut-away perspective view of a jack connector and a plug connector.

Figure 1:
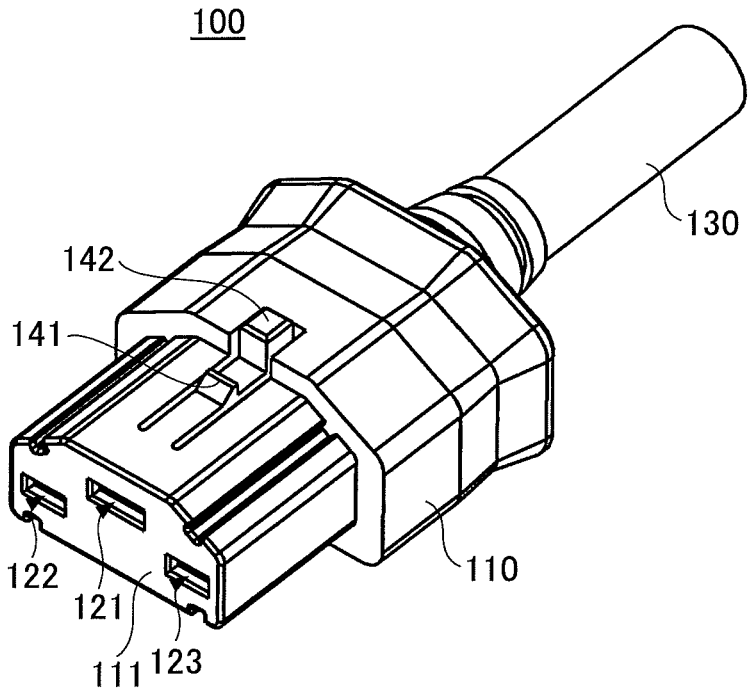
FIG. 1 is a perspective view of a jack connector according to an embodiment.
Figure 2:
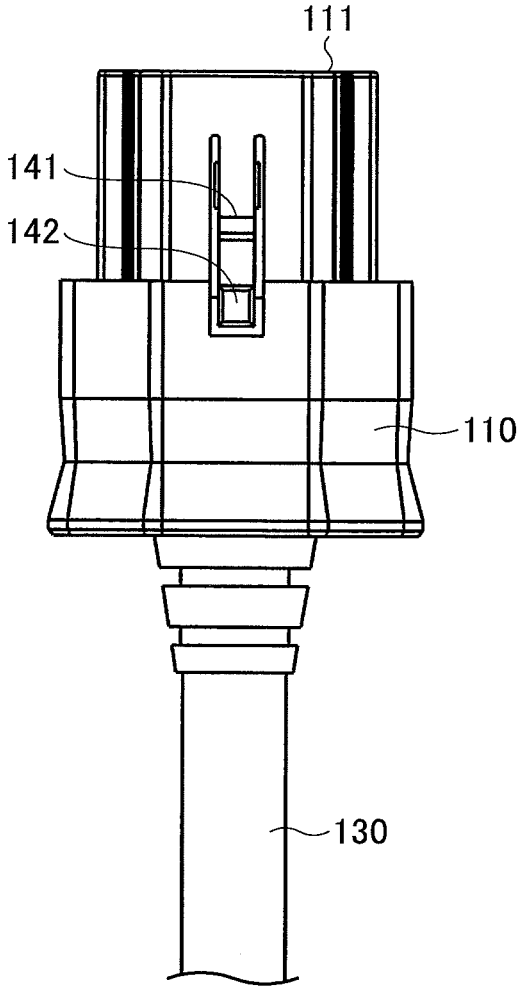
FIG. 2 is a top view of a jack connector according to an embodiment.
Figure 3:
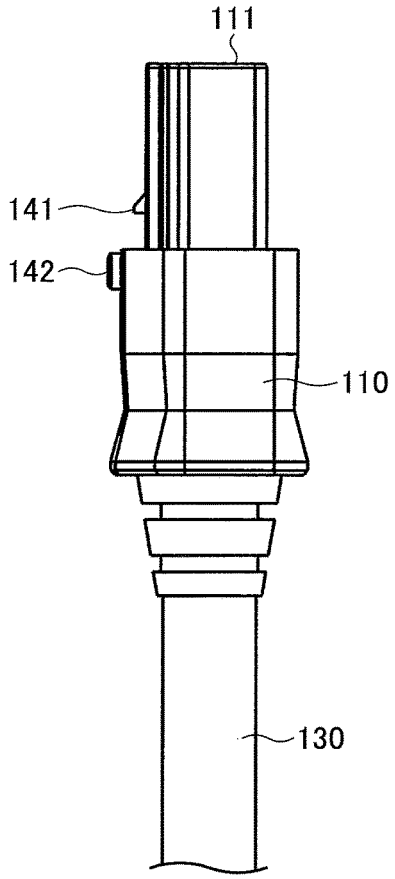
FIG. 3 is a side view of a jack connector according to an embodiment.
Figure 4:
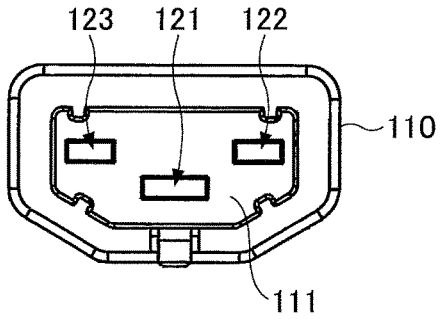
FIG. 4 is a front view of a jack connector according to an embodiment.

First, a jack connector 100 is described with reference to FIGS. 1 through 4. FIG. 1 is a perspective view, FIG. 2 is a top view, FIG. 3 is a side view, and FIG. 4 is a front view of the jack connector 100. The jack connector 100 includes a jack body 110 that constitutes a main part of the jack connector 100. In a contact surface 111 of the jack body 110, jack openings 121, 122, and 123 are formed to receive plug terminals of a plug connector 200 described later. Jack terminals (not shown) to be connected to the corresponding plug terminals are provided in the jack openings 121, 122, and 123. A power cable 130 is connected to the opposite side of the jack body 110 from the contact surface 111 in which the jack openings 121, 122, and 123 are formed. Also, the jack connector 100 includes a protrusion 141 for maintaining a state where the jack connector 100 and the plug connector 200 are fitted together, and a press part 142 for moving the position of the protrusion 141 up and down.

Figure 5:
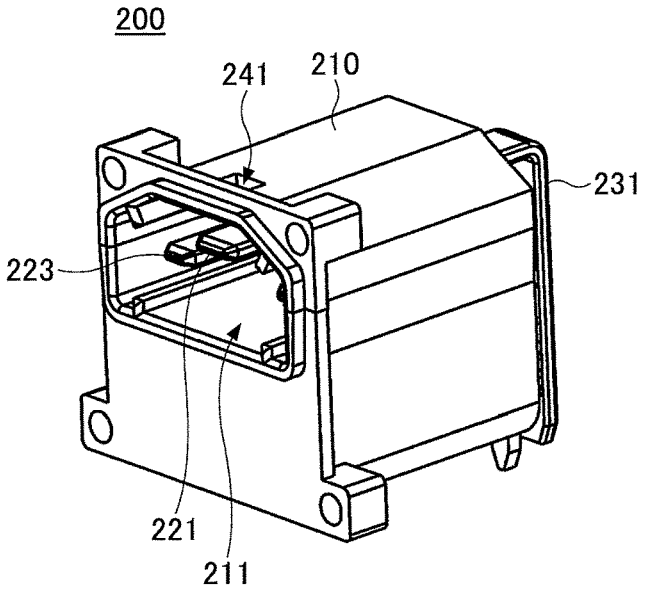
FIG. 5 is a perspective view of a plug connector according to an embodiment.
Figure 6:
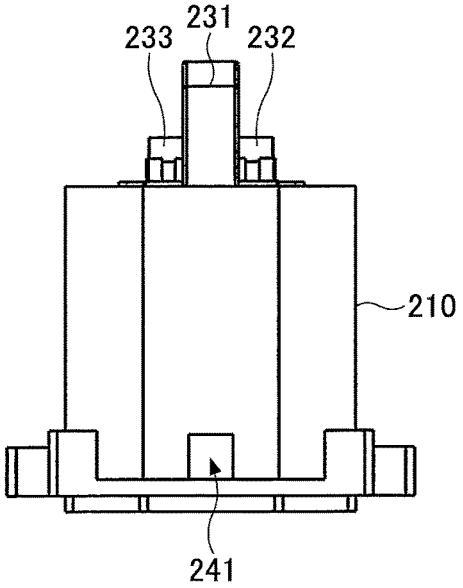
FIG. 6 is a top view of a plug connector according to an embodiment.
Figure 7:
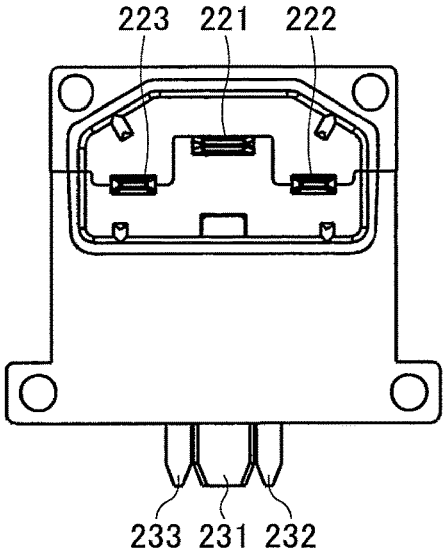
FIG. 7 is a side view of a plug connector according to an embodiment.

Next, the plug connector 200 is described with reference to FIGS. 5 through 9. FIG. 5 is a perspective view, FIG. 6 is a top view, FIG. 7 is a side view, FIG. 8 is a front view, and FIG. 9 is a cut-away view of the plug connector 200. The plug connector 200 includes a plug body 210, and plug terminals 221, 222, and 223 provided in a plug connector opening 211 of the plug body 210. The plug terminals 221, 222, and 223 are to be connected to the jack terminals provided in the jack openings 121, 122, and 123 of the jack connector 100. That is, the plug terminal 221 is connected to a jack terminal provided in the jack opening 121 of the jack connector 100, the plug terminal 222 is connected to a jack terminal provided in the jack opening 122 of the jack connector 100, and the plug terminal 223 is connected to a jack terminal provided in the jack opening 123 of the jack connector 100.

The plug connector 200 includes metal terminals 231, 232, and 233 provided on the outer side of the plug body 210 opposite from the side where the plug connector opening 211 is formed. The plug terminal 221 is a GND terminal that is longer than the plug terminals 222 and 223 and connected to the metal terminal 231.

Also, as illustrated by FIG. 9, the plug connector 200 of the present embodiment includes a switch 300 in the plug body 210. The switch 300 is connected to the plug terminals 222 and 223 and the metal terminals 232 and 233. When the switch 300 is closed, the plug terminal 222 and the metal terminal 232 are electrically connected to each other and similarly, the plug terminal 223 and the metal terminal 233 are electrically connected to each other.

An opening 241 is formed in the plug connector 200. The protrusion 141 of the jack connector 100 can enter the opening 241. When the jack connector 100 and the plug connector 200 are fitted together and the switch 300 is closed, the protrusion 141 of the jack connector 100 enters the opening 241 of the plug connector 200 such that the protrusion 141 is not easily pulled out of the opening 241. As a result, electric connection between the jack connector 100 and the plug connector 200 is maintained.

The jack connector 100 can be removed from the plug connector 200 by pressing the press part 142 of the jack connector 100 to move the protrusion 141 to a position below the opening 241 of the plug connector 200, and pulling the jack connector 100 and the plug connector 200 apart from each other.

<Switch>

Figure 12:
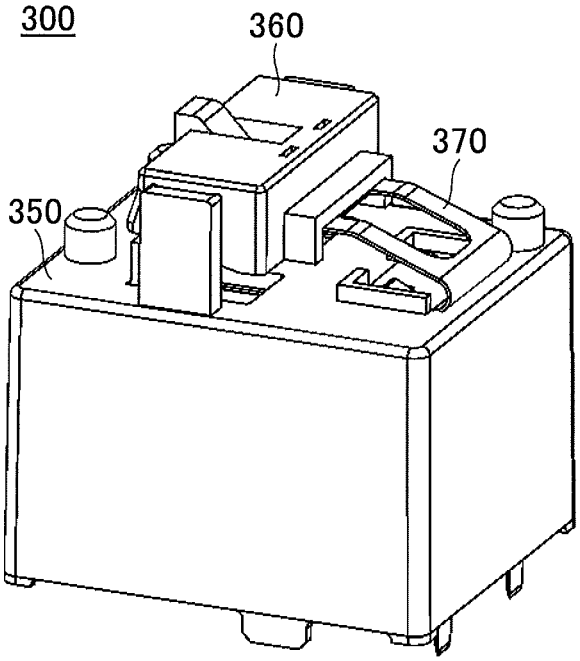
FIG. 12 is a perspective view of a switch.

Next, the switch 300 provided in the plug connector 200 is described. The switch 300 of the connector of the present embodiment controls supply of electric power, and is also referred to as a "power switch". FIG. 12 is an outer perspective view of the switch 300, and FIG. 13 illustrates an internal configuration of the switch 300.

Figure 13:
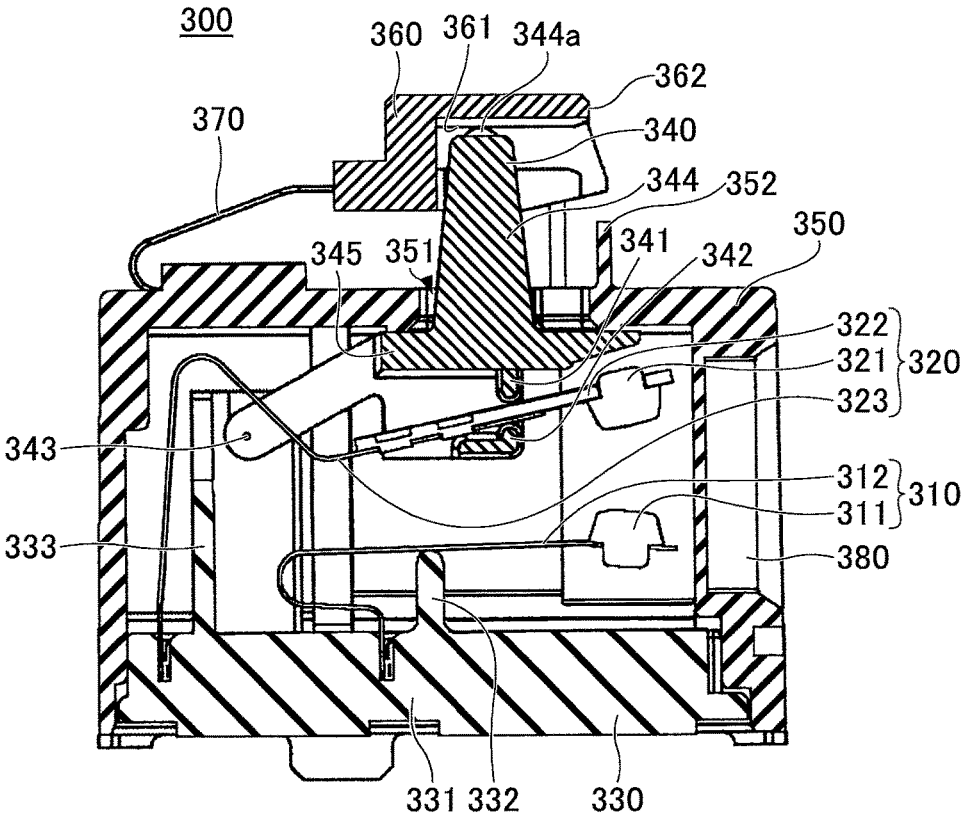
FIG. 13 is a drawing illustrating a configuration of a switch (OFF state)

As illustrated by FIG. 13, in the switch 300, a fixed contact(s) 311 of a fixed part 310 and a movable contact(s) 321 of a movable part 320 are brought into and out of contact with each other to turn on and off the supply of electric power.

The fixed part 310 is comprised of a conductive material such as metal, and includes a fixed spring 312 and the fixed contact 311 that is provided at a first end of the fixed spring 312 and to be brought into contact with the movable contact 321 of the movable part 320. The fixed spring 312 is formed by bending, for example, a metal plate comprised of copper or an alloy including copper. The fixed contact 311 is comprised of an alloy of silver and copper. A second end of the fixed spring 312 is fixed to a base block body 331 of a base block 330, and is also supported and fixed in the middle by a fixed part support 332.

The movable part 320 is comprised of a conductive material such as metal, and includes a movable plate 322, a movable spring 323, and the movable contact 321 that is provided at a first end of the movable plate 322 and to be brought into contact with the fixed contact 311 of the fixed part 310. A second end of the movable plate 322 is connected to a first end of the movable spring 323. Each of the movable plate 322 and the movable spring 323 is formed by bending, for example, a metal plate comprised of copper or an alloy including copper. The movable contact 321 is comprised of an alloy of silver and copper. A second end of the movable spring 323 is fixed to the base block body 331 of the base block 330. However, because the movable spring 323 is formed by bending, for example, a metal plate and has flexibility, the movable contact 321 provided at the first end of the movable plate 322 can be moved in the vertical direction. An insulating wall 333 composed of, for example, a fire-retardant resin material is provided between a part of the base block 330 to which the second end of the fixed spring 312 is fixed and a part of the base block 330 to which the second end of the movable spring 323 is fixed. The movable spring 323 is bent such that it extends from the second end around a part of the insulating wall 333.

An upper surface, or a first surface, of the movable plate 322 of the movable part 320 is in contact with an upper contact part 341, or a first contact part, of a card 340. A lower surface, or a second surface, of the movable plate 322 is in contact with a lower contact part 342, or a second contact part, of the card 340. In this state, when the card 340 is rotated around a rotational shaft 343, a force is applied to the movable plate 322 that is in contact with the upper contact part 341 or the lower contact part 342. As a result, the movable contact 321 moves in the vertical direction. Because the upper contact part 341 and the lower contact part 342 are to slide on the movable plate 322, a surface layer of, for example, a fluoroplastic may be formed on the surface of each of the upper contact part 341 and the lower contact part 342 to reduce frictional resistance.

The fixed part 310 and the movable part 320 are disposed inside of an area surrounded by the base block 330 and a switch case 350. The card 340 includes a protrusion 344 that protrudes out of the switch case 350 through a switch opening 351 formed in the switch case 350, and a card body 345 disposed in the area surrounded by the base block 330 and the switch case 350. Accordingly, in the switch 300, the upper contact part 341 and the lower contact part 342 are disposed in the area surrounded by the base block 330 and the switch case 350. The card 340, the base block 330, and the switch case 350 are comprised of an insulator material such as a resin.

A button 360 is provided outside of the switch case 350. When the button 360 is pressed, the card 340 is rotated around the rotational shaft 343. A contact part 344*a* is provided on an upper part of the protrusion 344 of the card 340. The contact part 344*a* is in contact with an inner wall 361 of the button 360. Because the contact part 344*a* is to slide on the surface of the inner wall 361, a surface layer of, for example, a fluoroplastic may be formed on the surface of the inner wall 361 to reduce frictional resistance. An opening spring 370 is provided outside of the switch case 350. One end of the opening spring 370 is connected to the switch case 350, and another end of the opening spring 370 is connected to the button 360.

<On and Off Operations of Switch>

Figure 14:
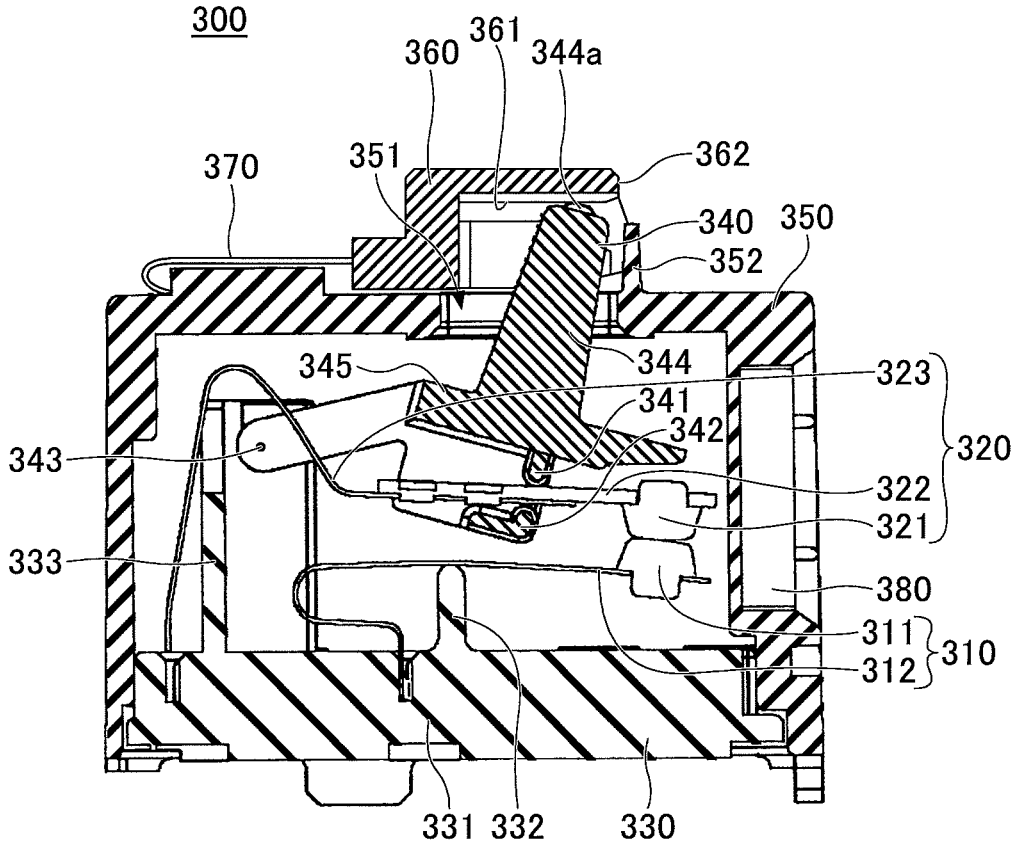
FIG. 14 is a drawing illustrating a configuration of a switch (ON state)

As described later, to turn on the switch 300, the jack connector 100 is inserted into the plug connector 200 until the protrusion 141 of the jack connector 100 enters the opening 241 of the plug connector 200. As a result, the contact surface 111 of the jack connector 100 pushes the button 360, the card 340, whose contact part 344*a* is in contact with the inner wall 361 of the button 360, rotates around the rotational shaft 343, a downward force is applied via the upper contact part 341 to the movable plate 322 of the movable part 320, and the movable contact 321 contacts the fixed contact 311. FIG. 14 illustrates the switch 300 in this state. In this state, a contact between the movable contact 321 and the fixed contact 311 is maintained and electric power is supplied from a power supply.

To turn off the switch 300, as described later, the plug connector 200 and the jack connector 100 are separated from each other. As a result, a force pushing the button 360 is lost, and the button 360 is caused to return to an OFF state by the restoring forces generated by the elasticity of the opening spring 370 and the movable spring 323. That is, as illustrated by FIG. 13, the card 340, whose contact part 344*a* is in contact with the inner wall 361 of the button 360, rotates around the rotational shaft 343, and an upward force is applied via the lower contact part 342 to the movable plate 322 of the movable part 320. The upward force applied to the movable plate 322 causes the movable contact 321 to move away from the fixed contact 311 and as a result, the supply of electric power from the power supply is stopped. When the movable contact 321 moves away from the fixed contact 311, an arc may be generated between the movable contact 321 and the fixed contact 311. To scatter the arc by the force of a magnetic field, a permanent magnet 380 is provided near a contact position between the movable contact 321 and the fixed contact 311. The permanent magnet 380 generates a magnetic field in a direction that is substantially perpendicular to the direction in which the arc is generated.

Also in the switch 300, the insulating wall 333 is provided at a position between a part of the base block 330 to which the second end of the fixed spring 312 is connected and a part of the base block 330 to which the second end of the movable spring 323 is connected. Even when the fixed part 310 and the movable part 320 are melted by heat, the insulating wall 333 separates a melted part of the fixed part 310 from a melted part of the movable part 320. Accordingly, the insulating wall 333 prevents the melted parts of the fixed part 310 and the movable part 320 from fusing with each other and causing an electric current to continuously flow.

When, for example, dust enters an area surrounded by the base block 330 and the switch case 350 of the switch 300, the dust may cause a short circuit or a poor contact between the fixed contact 311 and the movable contact 321. When the switch 300 is in the OFF state, to prevent entry of, for example, dust into the area surrounded by the base block 330 and the switch case 350, an upper surface of the card body 345 of the card 340 is in contact with and pressed against the switch case 350 to close the switch opening 351. This configuration makes it possible to prevent entry of, for example, dust via the switch opening 351 into the switch case 350 while the switch 300 is in the OFF state.

To prevent entry of, for example, dust into the area surrounded by the base block 330 and the switch case 350 while the switch 300 is in an ON state, a wall 352 is provided near the switch opening 351 of the switch case 350, and the button 360 includes a square-bracket shaped end 362. When the switch 300 is in the ON state, the square-bracket shaped end 362 of the button 360 covers the wall 352 of the switch case 350 so that the switch opening 351 is closed by the wall 352 and the end 362. This configuration makes it possible to prevent entry of, for example, dust via the switch opening 351 into the switch case 350 while the switch 300 is in the ON state.

<Method of Connecting Connectors>

Next, a method of connecting connectors according to the present embodiment is described. More specifically, a process where the jack connector 100 and the plug connector 200 apart from each other as illustrated by FIGS. 10 and 11 are fitted together and electrically connected is described with reference to FIGS. 15 through 18. In the descriptions below, connection between a jack terminal 153 and the plug terminal 223 is used as an example. However, in a similar manner, the plug terminal 223 and a corresponding jack terminal of the jack connector 100 are connected to each other, and the plug terminal 221 and a jack terminal 151 are also connected to each other.

Figure 15:
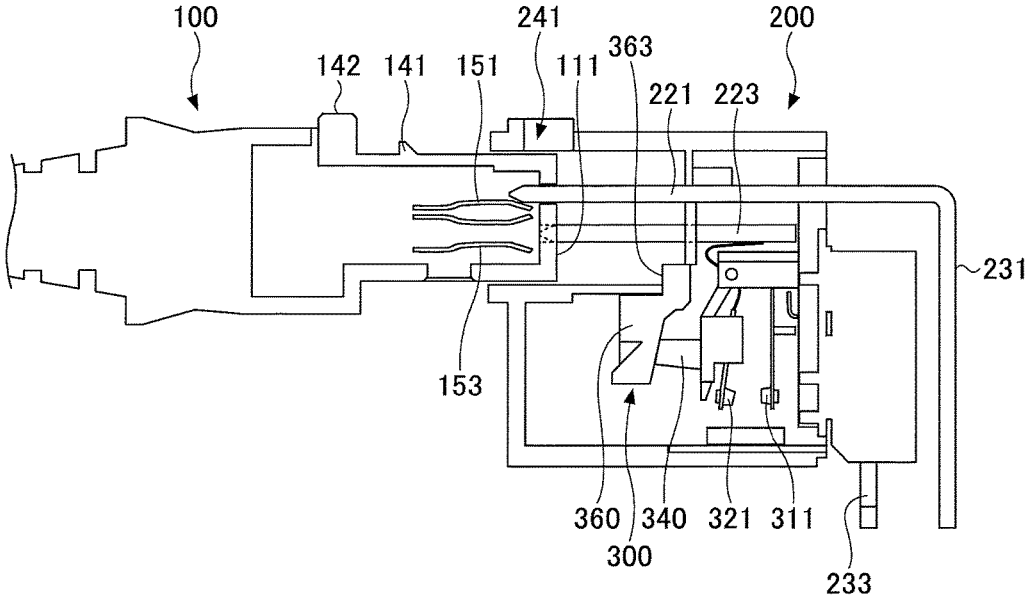
FIG. 15 is a drawing (1) illustrating a process of connecting connectors.

First, as illustrated by FIG. 15, a part of the jack connector 100 having the contact surface 111 is inserted into the plug connector opening 211 of the plug connector 200. As a result, the jack terminal 151 provided in the jack opening 121 of the jack connector 100 contacts the plug terminal 221 that is a GND terminal of the plug connector 200 and is longer than other plug terminals.

Figure 16:
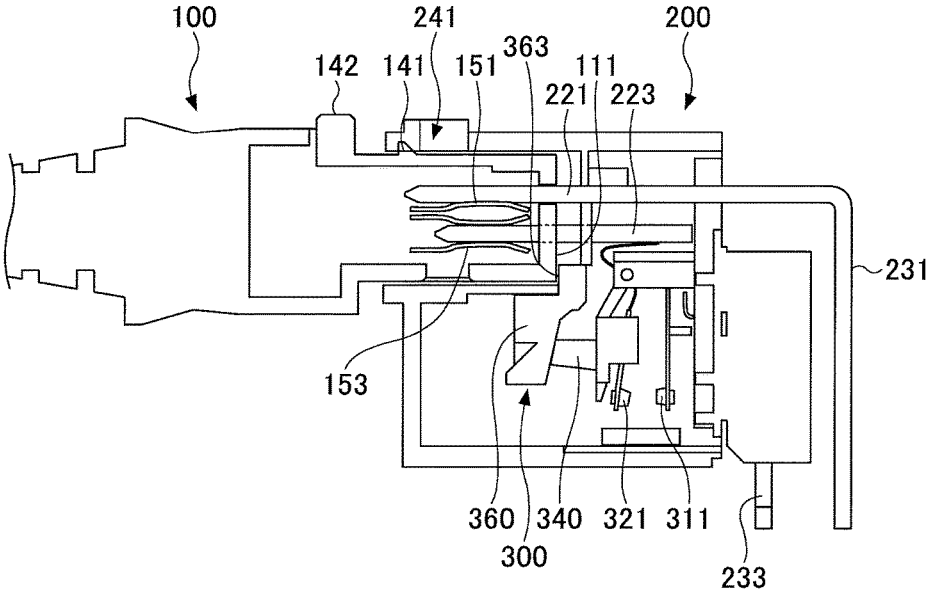
FIG. 16 is a drawing (2) illustrating a process of connecting connectors.

Next, as illustrated by FIG. 16, the part of the jack connector 100 having the contact surface 111 is inserted further into the plug connector opening 211 of the plug connector 200. As a result, the jack terminal 153 provided in the jack opening 123 of the jack connector 100 contacts the plug terminal 223 of the plug connector 200. In this state, however, the switch 300 is not closed. That is, the fixed contact 311 and the movable contact 321 of the switch 300 are not in contact with each other, and electric power is not being supplied to the metal terminals 232 and 233 of the plug connector 200.

Figure 17:
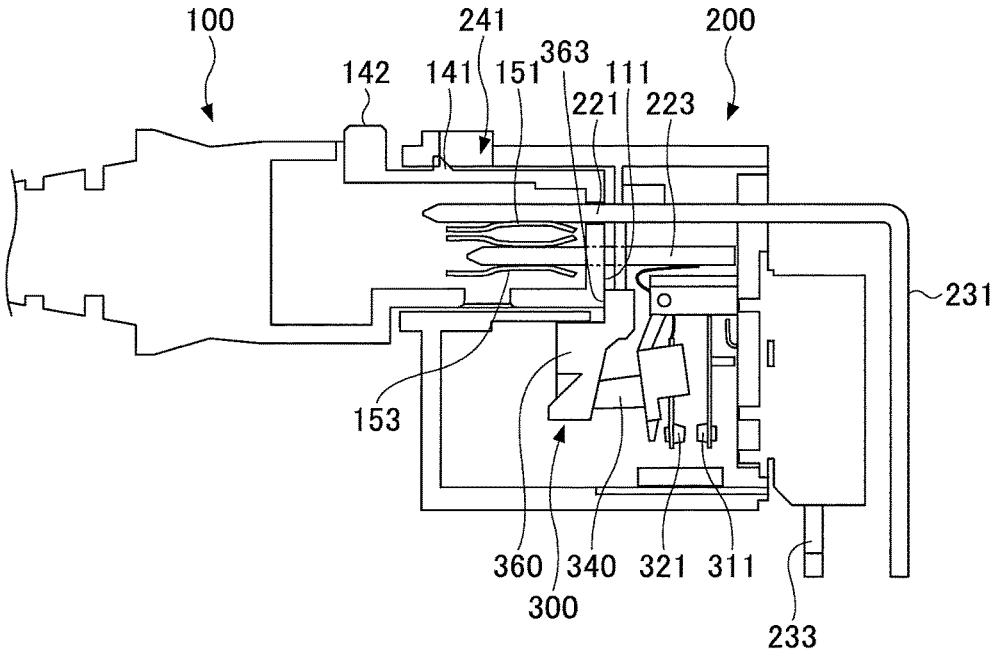
FIG. 17 is a drawing (3) illustrating a process of connecting connectors.

Next, as illustrated by FIG. 17, the part of the jack connector 100 having the contact surface 111 is inserted further into the plug connector opening 211 of the plug connector 200. As a result, the contact surface 111 of the jack connector 100 contacts a button contact part 363 of the button 360 and pushes the button contact part 363, and the button 360 moves. In this state, although the movable contact 321 is at a position close to the fixed contact 311 in the switch 300, the movable contact 321 is not in contact with the fixed contact 311 and the switch 300 is not closed. Accordingly, electric power is not being supplied to the metal terminals 232 and 233 of the plug connector 200.

Figure 18:
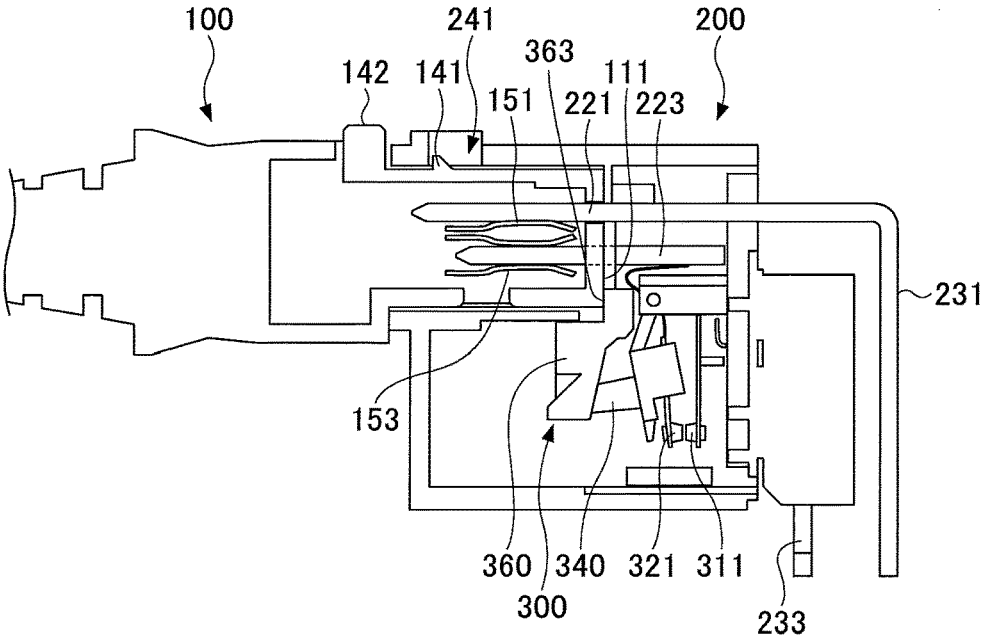
FIG. 18 is a drawing (4) illustrating a process of connecting connectors.

Next, as illustrated by FIG. 18, the part of the jack connector 100 having the contact surface 111 is inserted substantially completely into the plug connector opening 211 of the plug connector 200. As a result, the contact surface 111 of the jack connector 100 further pushes the button contact part 363 of the button 360, the button 360 moves, and the movable contact 321 contacts the fixed contact 311 in the switch 300. Accordingly, the jack connector 100 and the plug connector 200 are electrically connected to each other. That is, the jack terminal 153 provided in the jack opening 123 of the jack connector 100 is electrically connected to the metal terminal 233 of the plug connector 200 via the plug terminal 223, the movable contact 321, and the fixed contact 311 of the plug connector 200. As a result, electric power is supplied to the metal terminals 232 and 233 of the plug connector 200 from the jack connector 100.

In this state, the protrusion 141 of the jack connector 100 is in the opening 241 of the plug connector 200 such that the protrusion 141 is not easily pulled out of the opening 241 and the electric connection is maintained.

When removing the jack connector 100 from the plug connector 200, the press part 142 of the jack connector 100 is pressed to move the protrusion 141 downward and out of the opening 241 of the plug connector 200, and the above process is performed in the reverse order.

Embodiments of the present invention are described above. However, the present invention is not limited to the specifically disclosed embodiments.

The present application is based on and claims the benefit of priority of Japanese Patent Application No. 2013-134110 filed on Jun. 26, 2013, the entire contents of which are hereby incorporated herein by reference.

EXPLANATION OF REFERENCE NUMERALS

100 Jack connector
110 Jack body
111 Contact surface
121 Jack opening
122 Jack opening
123 Jack opening
130 Power cable
141 Protrusion
142 Press part
151 Jack terminal
153 Jack terminal
200 Plug connector
210 Plug body
221 Plug terminal
222 Plug terminal
223 Plug terminal
231 Metal terminal
232 Metal terminal
233 Metal terminal
241 Opening
300 Switch
310 Fixed part
311 Fixed contact
312 Fixed spring
320 Movable part
321 Movable contact
322 Movable plate
323 Movable spring
330 Base block
331 Base block body
332 Fixed part support
333 Insulating wall
340 Card
341 Upper contact part (first contact part)
342 Lower contact part (second contact part)
343 Rotational shaft
344 Protrusion
**344*a*** Contact part
345 Card body
350 Switch case
351 Switch opening
352 Wall
360 Button
361 Inner wall
362 End
363 Button contact part
370 Opening spring
380 Permanent magnet

The invention claimed is:

1. A connector to be connected to another connector, the connector comprising:

a connection terminal;

a fixed contact;

a movable contact provided at an end of a movable plate;

a card comprised of an insulator and configured to move the movable plate; and a button configured to move the card, wherein the connector is configured such that when the another connector is inserted into a connector opening of the connector to bring another connection terminal of the another connector into contact with the connection terminal of the connector, the button is pushed by an end face of the another connector, the pushed button moves the card, and the card moves the movable plate to cause the movable contact to contact the fixed contact;

the button includes a button contact part that contacts the end face of the another connector and an inner wall that contacts a card contact part of the card; and an entirety of the button contact part and an entirety of the inner wall are apart from each other in a first direction that is orthogonal to a second direction in which the another connector is inserted into the connector opening.

2. The connector as claimed in claim 1, wherein the connector includes a plurality of pairs of the fixed contact and the movable contact.

3. The connector as claimed in claim 1, wherein an opening is formed in the connector, the opening corresponding to a protrusion provided on a body of the another connector; and when the fixed contact and the movable contact are in contact with each other, the protrusion of the another connector enters the opening of the connector.

4. The connector as claimed in claim 1, wherein the connector is a plug connector; and the connection terminal is a plug terminal.

5. The connector as claimed in claim 1, wherein the card is configured to rotate when the button is pushed.

6. The connector as claimed in claim 1, wherein a distance in the first direction between the button contact part and a portion of the card contact part contacting the inner wall in a state where the movable contact is in contact with the fixed contact is greater than a distance in the first direction between the button contact part and the portion of the card contact part contacting the inner wall in a state where the movable contact is not in contact with the fixed contact.

7. A connector to be connected to another connector to which a cable is fixed, the connector comprising:

a plug body having a connector opening into which the another connector is to be inserted;

a connection terminal to be connected to another connection terminal provided in the another connector;

a fixed contact;

a movable contact provided at an end of a movable plate;

a card configured to move the movable plate; and a button configured to move the card, wherein the button includes a button contact part that contacts an end face of the another connector inserted into the connector opening, and an inner wall that contacts a card contact part of the card;

when the another connector is inserted into the connector opening, the button is pushed by the end face in an insertion direction in which the another connector is inserted into the connector opening, the pushed button moves the card, and the card moves the movable plate in the insertion direction to cause the movable contact to contact the fixed contact; and the connector opening and the inner wall are apart from each other in a direction that is orthogonal to the insertion direction.

* * * * *